US007861460B1

(12) United States Patent
Costello et al.

(10) Patent No.: US 7,861,460 B1
(45) Date of Patent: Jan. 4, 2011

(54) EMERGENCY WINDOW OPENING SYSTEM

(76) Inventors: Anthony Costello, 300 Route 59, Tallman, NY (US) 10982; Bella Costello, 300 Route 59, Tallman, NY (US) 10982

( * ) Notice: Subject to any disclaimer, the term of this patent is extended or adjusted under 35 U.S.C. 154(b) by 477 days.

(21) Appl. No.: 11/954,522

(22) Filed: Dec. 12, 2007

(51) Int. Cl.
*E06B 65/10* (2006.01)

(52) U.S. Cl. ..... 49/141; 180/281; 180/282; 180/283; 318/283

(58) Field of Classification Search ..... 49/141, 49/349, 502; 180/271, 281, 282, 283, 286; 318/280, 283
See application file for complete search history.

(56) References Cited

U.S. PATENT DOCUMENTS

| | | | | | |
|---|---|---|---|---|---|
| 3,479,767 | A | * | 11/1969 | Lastinger et al. | 49/280 |
| 4,001,661 | A | | 1/1977 | Terabayashi | |
| D310,202 | S | | 8/1990 | Suck | |
| 5,327,990 | A | * | 7/1994 | Busquets | 180/271 |
| 5,406,270 | A | | 4/1995 | Van Lente | |
| 5,559,375 | A | | 9/1996 | Jo et al. | |
| 5,574,315 | A | * | 11/1996 | Weber | 307/10.1 |
| 5,799,516 | A | * | 9/1998 | Zintler | 70/92 |
| 6,072,290 | A | * | 6/2000 | Takagi et al. | 318/283 |
| 6,081,085 | A | | 6/2000 | Ohashi et al. | |
| 6,278,250 | B1 | * | 8/2001 | Sasaki | 318/283 |
| 6,281,647 | B1 | * | 8/2001 | Sasaki | 318/264 |
| 6,288,506 | B1 | * | 9/2001 | Hiwatari | 318/283 |
| 6,483,267 | B1 | * | 11/2002 | Jurney | 318/283 |
| 6,515,377 | B1 | * | 2/2003 | Ubelein et al. | 307/10.1 |
| 6,580,241 | B1 | | 6/2003 | Sugawara | |
| 6,938,921 | B2 | * | 9/2005 | Fisher | 280/730.2 |
| 7,246,676 | B2 | * | 7/2007 | Cantu | 180/268 |
| 7,424,353 | B2 | * | 9/2008 | Engelhardt et al. | 701/45 |
| 7,588,116 | B2 | * | 9/2009 | Kamiya | 180/274 |
| 2002/0023797 | A1 | * | 2/2002 | Baca | 180/271 |

* cited by examiner

*Primary Examiner*—Jerry Redman

(57) ABSTRACT

An emergency window opening system includes a vehicle, a vehicle door attached to the vehicle and a window mounted in the vehicle door. A primary window motor is mechanically coupled to a lift gear mechanically coupled to the window to allow selective raising or lowering of the window. A housing is mounted within the vehicle door. A secondary motor is mounted within the housing. A drive shaft of the secondary motor is mechanically coupled to the lift gear. The secondary motor lowers the window when turned on. An actuator is mounted on the vehicle door and is electrically coupled by a wire to the secondary motor. The secondary motor is turned on when the actuator is actuated. A power supply line extends between and directly electrically couples a battery to the secondary motor. The power supply line extends into the housing.

9 Claims, 3 Drawing Sheets

EMERGENCY WINDOW OPENING SYSTEM

BACKGROUND OF THE INVENTION

1. Field of the Invention

The present invention relates to car window opening devices and more particularly pertains to a new car window opening device for allowing the opening of a vehicle's electric window when the power to electric window has failed or cannot be accessed.

2. Description of the Prior Art

The use of car window opening devices is known in the prior art. While these devices fulfill their respective, particular objectives and requirements, the need remains for a system that ensures a person in a vehicle can open the window of the vehicle even if the window is electrically controlled and there is no power to the window. Such a system is particularly important where the vehicle is submerged in water and the window's motor has shorted out or cannot be turned on. The system may further include means for detecting a crash so that the window or windows are automatically lowered after the crash. Further, the system may be retrofitted to existing electric window assemblies.

SUMMARY OF THE INVENTION

The present invention meets the needs presented above by generally comprising a vehicle, a vehicle door attached to the vehicle and a window mounted in the vehicle door. A primary window motor is mechanically coupled to a lift gear to selectively rotate the lift gear in a first direction or a second direction. The lift gear is mechanically coupled to the window to allow selective raising of the window when the lift gear is rotated in the first direction or lowering of the window when the lift gear is rotated in the second direction. The primary window motor is turned on only when an ignition switch of the vehicle has been actuated. A housing is mounted within the vehicle door. A secondary motor is mounted within the housing. A drive shaft of the secondary motor extends through the housing and is mechanically coupled to the lift gear. The secondary motor rotates the lift gear only in the second direction when the secondary motor is turned on. An actuator is mounted on the vehicle door and is electrically coupled by a wire to the secondary motor. The secondary motor is turned on when the actuator is actuated. A power supply line extends between and directly electrically couples a battery to the secondary motor. The power supply line extends into the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
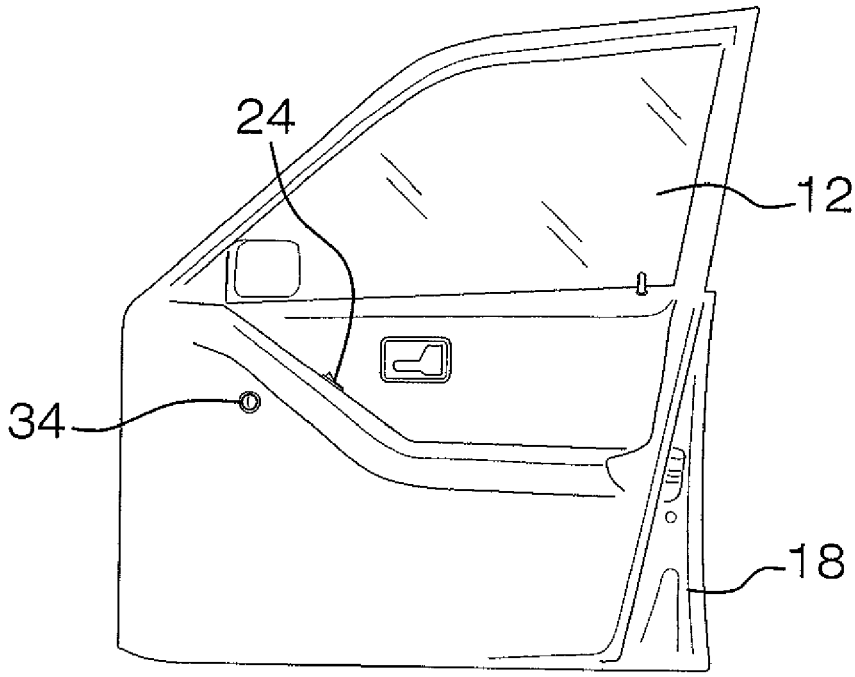
FIG. 1 is a side view of a door of a emergency window opening system according to the present invention.
Figure 2:
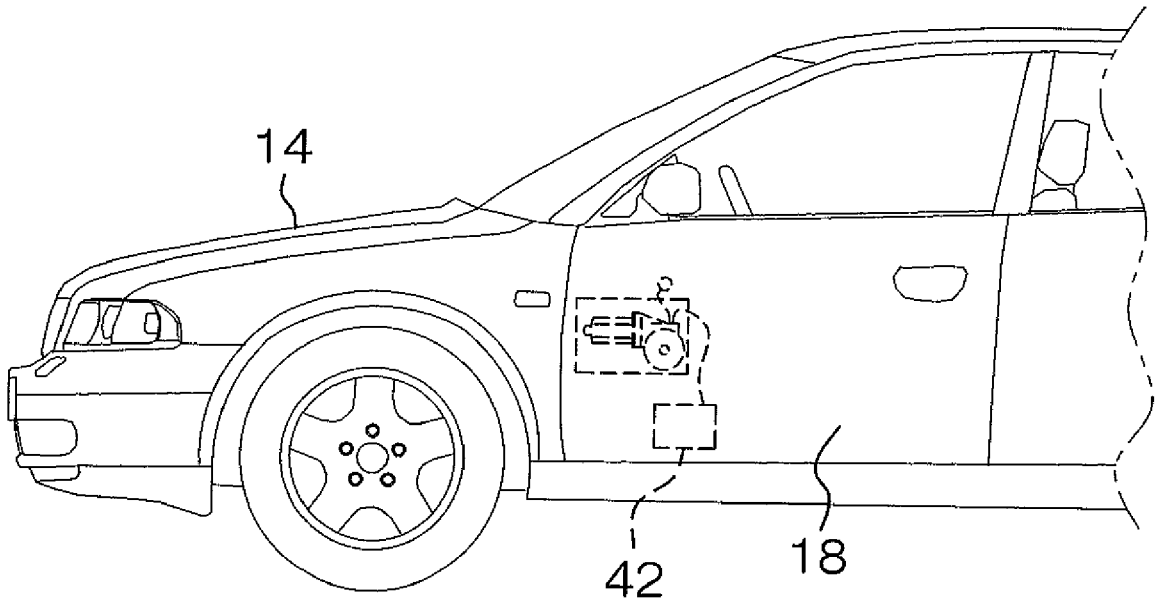
FIG. 2 is a side view of a vehicle of the present invention.
Figure 3:
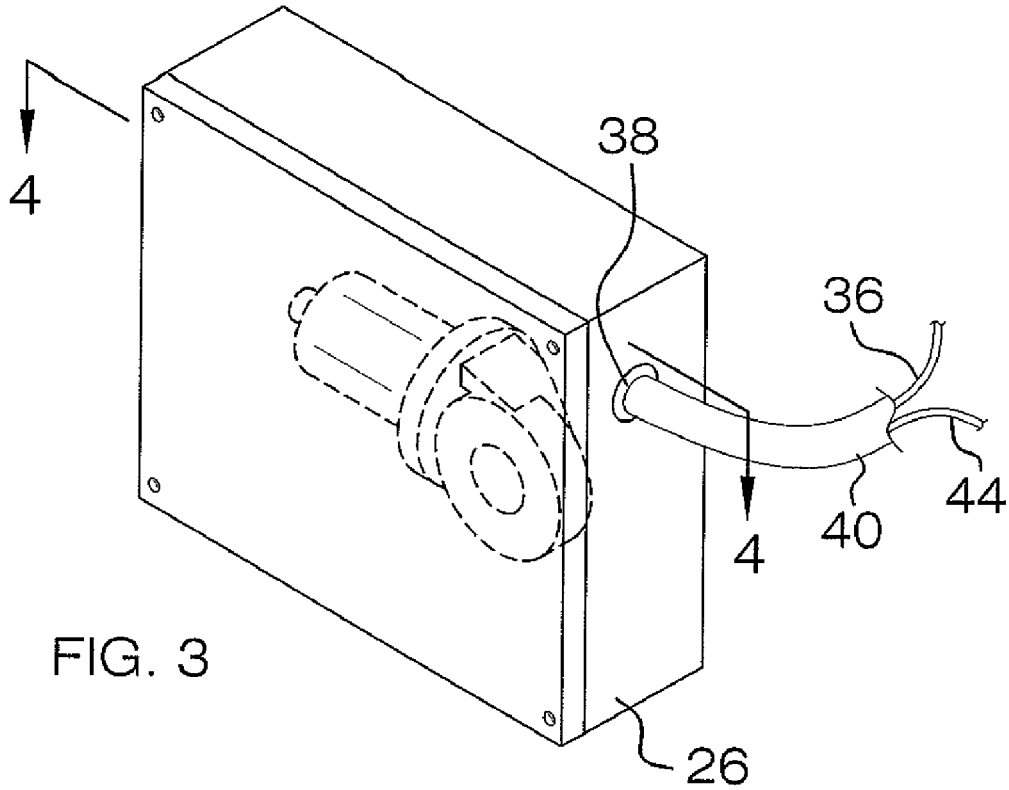
FIG. 3 is a perspective view of a housing of the present invention.
Figure 4:
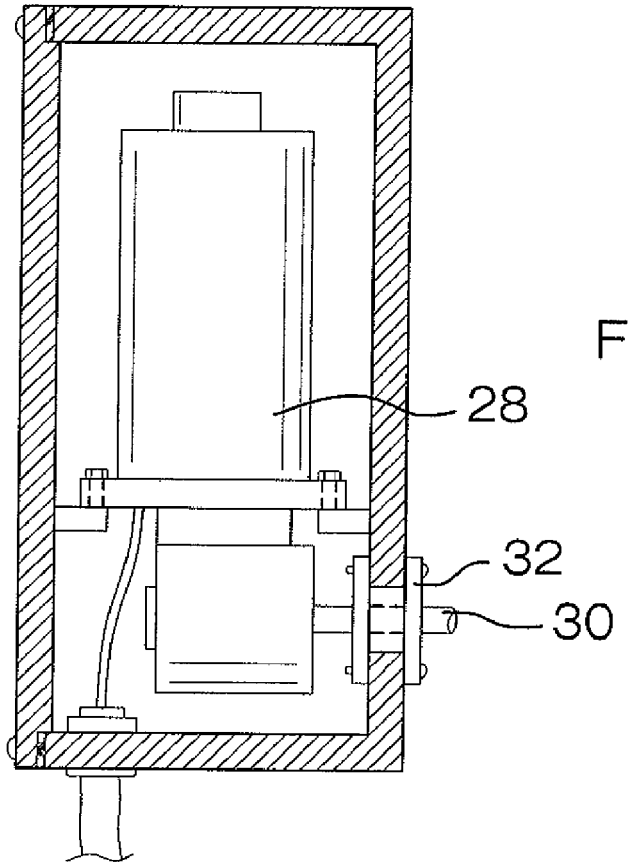
FIG. 4 is a cross-sectional view taken along line 4-4 of FIG. 3 of the present invention.
Figure 5:
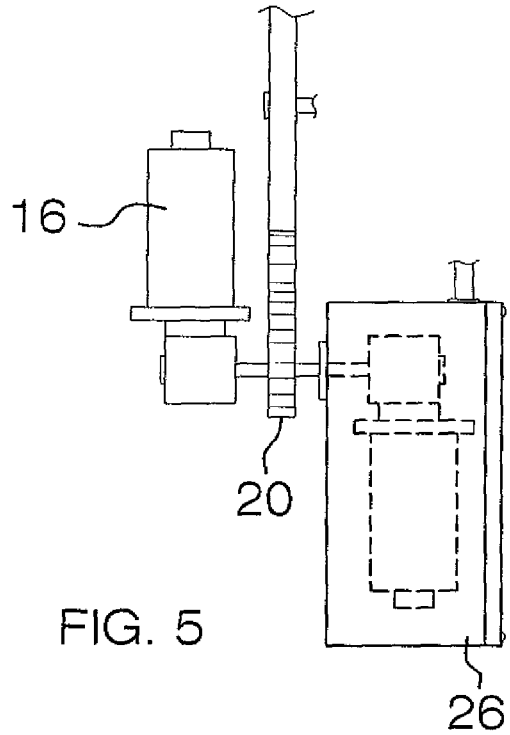
FIG. 5 is an end view of the housing of the present invention.
Figure 6:
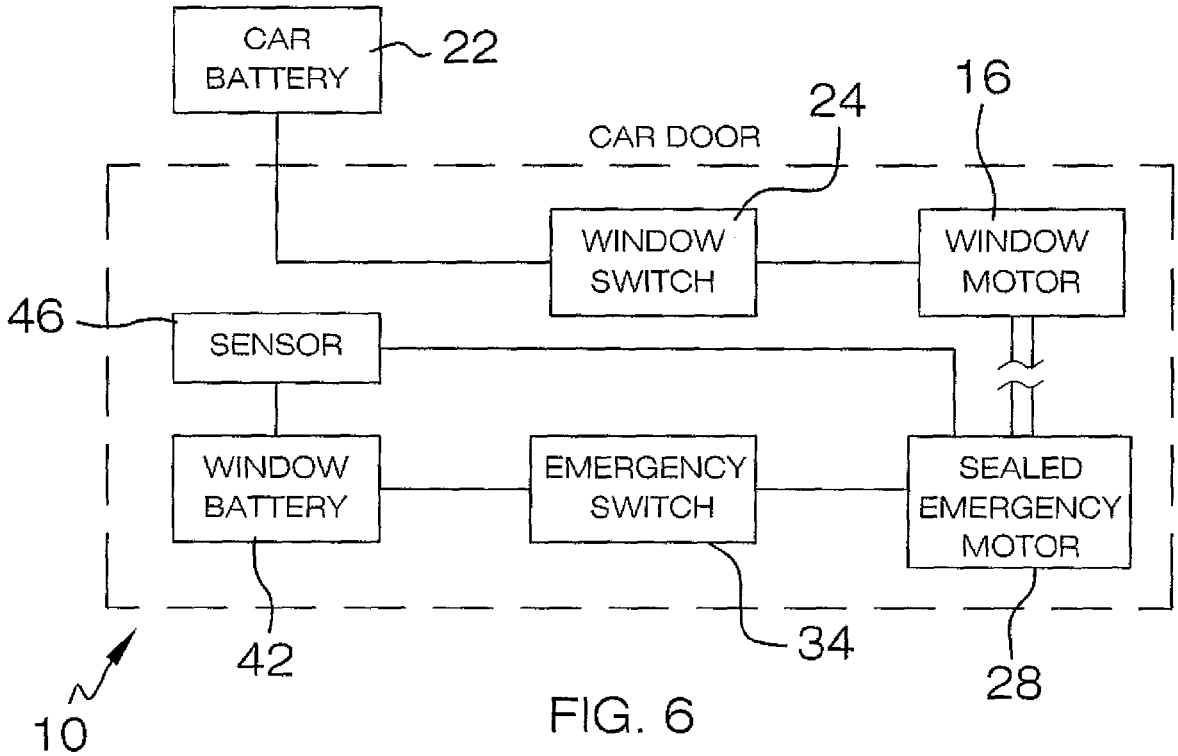
FIG. 6 is a schematic view of the present invention.

With reference now to the drawings, and in particular to FIGS. 1 through 6 thereof, a new car window opening device embodying the principles and concepts of the present invention and generally designated by the reference numeral 10 will be described.

As best illustrated in FIGS. 1 through 6, the emergency window opening system 10 allows the opening of a window 12 of a vehicle 14 without vehicle 14 actuation or primary window motor 16 actuation. The system 10 includes a vehicle 14 and a vehicle door 18 attached to the vehicle 12 and has the window mounted therein. The primary window motor 18 is mechanically coupled to a lift gear 20 to selectively rotate the lift gear 20 in a first direction or a second direction. The lift gear 20 is mechanically coupled to the window 12 to allow selective raising of the window 12 when the lift gear 20 is rotated in the first direction or lowering of the window 12 when the lift gear 20 is rotated in the second direction. The primary window motor 16 is turned on only when an ignition switch of the vehicle 14 has been actuated. The above structural configuration is conventional and is connected to a battery 22 of the vehicle 14. This configuration further includes a switch 24 for turning the primary window motor 16 on in a first direction or a second direction. However, this structure requires that the vehicle 14 ignition switch be turned on for the primary window motor 16 to function.

A housing 26 is mounted within the vehicle door 18. The housing 26 is sealed against water entering an interior of the housing 26. A secondary motor 28 is mounted within the housing 26. A drive shaft 30 of the secondary motor 28 extends through the housing 26 and is mechanically coupled to the lift gear 20. A seal 32 is mounted on the housing 26 and extends around the drive shaft 30. The secondary motor 28 rotates the lift gear 20 only in the second direction when the secondary motor 28 is turned on to lower the window 12.

An actuator 34 is mounted anywhere on the vehicle door 18 or its control panel and is electrically coupled by a wire 36 to the secondary motor 28. The secondary motor 28 is turned on when the actuator 34 is actuated. The wire 36 extends into the housing 26. A seal 38 is positioned on the housing 26 and extends around the wire 36. Insulation 40 is positioned on the wire 36 and insulates the wire against water.

A battery 42 is mounted in the car door 18 and a power supply line 44 extends between and electrically couples the battery 42 to the secondary motor 28. The power supply line 44 extends into the housing 26 and is also insulated against water. It should be understood that the battery 42 may comprise the vehicle's battery 22, but that the supply line 44 would directly couple the vehicle's battery 22 to the secondary motor 28 and would bypass the ignition switch of the vehicle 14.

A crash sensor 46 is electrically coupled to the secondary motor 28. The crash sensor 46 detects a first parameter and a second parameter. The first parameter is an acceleration greater than 25 g (25 times the acceleration of gravity) and the second parameter is an angle greater than 45 degrees with respect to horizontal. The crash sensor 46 turns on the secondary motor 28 when either of the first or second parameters is detected. This will ensure that if the vehicle 14 rolls over or if driver of the vehicle 14 is in a severe crash, the secondary motor 28 will automatically roll down the window.

It should be understood that the battery 42 may also be electrically coupled to the primary motor 16 so that the battery 42 positioned within the door 18 may be used to supply power to the primary power motor 16 in the event of vehicle battery 22 failure. In this embodiment, the actuator 34 and crash sensor 46 may also be electronically coupled to the primary motor 16. Further, in such an embodiment, a secondary motor 28 may also be used which is again in communication with the crash sensor 46 and actuator 34 as more fully described above.

In use, the secondary motor 28 is actuated when the vehicle 14 has been in an accident, or has plunged into water, and the primary window motor 16 is not functioning or the electrical system of the vehicle 14 has been automatically shut down. The secondary motor 28 will ensure that the driver and passengers of the vehicle 14 will have an exit from the vehicle 14 after the accident as it includes its own battery 42 which is independent of the vehicle ignition and electrical system. It should be further understood that the system 10 may be used with all vehicle doors 18 by positioning one system in combination with each door 18.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An emergency window opening system to allow opening of a window of a vehicle without vehicle actuation or primary window motor actuator, said system including:

a vehicle;

a vehicle door attached to the vehicle and having the window mounted therein, the primary window motor being mechanically coupled to a lift gear to selectively rotate the lift gear in a first direction or a second direction, the lift gear is mechanically coupled to the window to allow selective raising of the window when the lift gear is rotated in the first direction or lowering of the window when said lift gear is rotated in the second direction, said primary window motor being turned on only when an ignition switch of the vehicle has been actuated;

a housing being mounted within the vehicle door;

a secondary motor being mounted within the housing, a drive shaft of the secondary motor extending through said housing and being mechanically coupled to said lift gear, said secondary motor rotating said lift gear only in said second direction when said secondary motor is turned on;

an actuator being mounted on the vehicle door and being electrically coupled by a wire to the secondary motor, said secondary motor being turned on when said actuator is actuated;

a power supply line extending between and directly electrically coupling a battery to said secondary motor, said power supply line extending into said housing; and a crash sensor being electrically coupled to said secondary motor, said crash sensor detecting a first parameter, said first parameter being an acceleration greater than 25 times the force of gravity, said crash sensor turning on said secondary motor when said first parameter is detected.

2. The system according to claim 1, wherein said housing is sealed against water entering an interior of said housing.

3. The system according to claim 2, wherein insulation is positioned on said wire and insulates said wire against water.

4. The system according to claim 1, wherein said battery is mounted in the car door.

5. The system according to claim 1, wherein said crash sensor further detects a second parameter, said second parameter being an angle greater than 45 degrees with respect to horizontal, said crash sensor turning on said secondary motor when said second parameter is detected.

6. An emergency window opening system to allow opening of a window of a vehicle without vehicle actuation or primary window motor actuator, said system including:

a vehicle;

a vehicle door attached to the vehicle and having the window mounted therein, the primary window motor being mechanically coupled to a lift gear to selectively rotate the lift gear in a first direction or a second direction, the lift gear is mechanically coupled to the window to allow selective raising of the window when the lift gear is rotated in the first direction or lowering of the window when said lift gear is rotated in the second direction, said primary window motor being turned on only when an ignition switch of the vehicle has been actuated;

a housing being mounted within the vehicle door, said housing being sealed against water entering an interior of said housing;

a secondary motor being mounted within the housing, a drive shaft of the secondary motor extending through said housing and being mechanically coupled to said lift gear, a seal being mounted on said housing and extending around said drive shaft, said secondary motor rotating said lift gear only in said second direction when said secondary motor is turned on;

an actuator being mounted on the vehicle door and being electrically coupled by a wire to the secondary motor, said secondary motor being turned on when said actuator is actuated, said wire extending into said housing, a seal being positioned on said housing and extending around said wire, insulation being positioned on said wire and insulating said wire against water;

a battery being mounted in the car door, a power supply line extending between and electrically coupling said battery to said secondary motor, said power supply line extending into said housing, said supply line being insulated against water; and a crash sensor being electrically coupled to said secondary motor, said crash sensor detecting a first parameter and a second parameter, said first parameter being an acceleration greater than 25 times the force of gravity and said second parameter being an angle greater than 45 degrees with respect to horizontal, said crash sensor turning on said secondary motor when either of said first or second parameters is detected.

7. An emergency window opening system to allow opening of a window of a vehicle without vehicle actuation or primary window motor actuator, said system including:

a vehicle;

a vehicle door attached to the vehicle and having the window mounted therein, the primary window motor being mechanically coupled to a lift gear to selectively rotate the lift gear in a first direction or a second direction, the lift gear is mechanically coupled to the window to allow selective raising of the window when the lift gear is rotated in the first direction or lowering of the window when said lift gear is rotated in the second direction, said primary window motor being turned on only when an ignition switch of the vehicle has been actuated;

an actuator being mounted on the vehicle door and being electrically coupled by a wire to the primary window motor, said primary window motor, being turned on when said actuator is actuated; and a battery being mounted in the car door, said battery being electrically coupled to said to said primary window motor; and a crash sensor being electrically coupled to said primary, said crash sensor detecting a first parameter, said first parameter being an acceleration greater than 25 times the force of gravity, said crash sensor turning on said primary motor when said first parameter is detected.

8. The system according to claim 7, wherein said crash sensor further detects a second parameter, said second parameter being an angle greater than 45 degrees with respect to horizontal, said crash sensor turning on said primary motor when said second parameter is detected.

9. The system according to claim 8, further including:

a housing being mounted within the vehicle door, said housing being sealed against water entering an interior of said housing;

a secondary motor being mounted within the housing, a drive shaft of the secondary motor extending through said housing and being mechanically coupled to said lift gear, a seal being mounted on said housing and extending around said drive shaft, said secondary motor rotating said lift gear only in said second direction when said secondary motor is turned on;

said secondary motor being electrically coupled to said actuator by a wire, said secondary motor being turned on when said actuator is actuated, said wire extending into said housing, a seal being positioned on said housing and extending around said wire, insulation being positioned on said wire and insulating said wire against water;

a power supply line extending between and electrically coupling said battery to said secondary motor, said power supply line extending into said housing, said supply line being insulated against water; and said crash sensor being electrically coupled to said secondary motor, said crash sensor, said crash sensor turning on said secondary motor when either of said first or second parameters is detected.

* * * * *